US007430829B2

(12) United States Patent
Murello

(10) Patent No.: US 7,430,829 B2
(45) Date of Patent: Oct. 7, 2008

(54) ACCESSORY MOUNTING DEVICES FOR FIREARMS AND METHODS OF MOUNTING THE SAME

(75) Inventor: Johannes Murello, Deisslingen (DE)

(73) Assignee: Heckler & Koch GmbH, Oberndorf/Neckar (DE)

( * ) Notice: Subject to any disclaimer, the term of this patent is extended or adjusted under 35 U.S.C. 154(b) by 0 days.

(21) Appl. No.: 11/341,173

(22) Filed: Jan. 27, 2006

(65) Prior Publication Data

US 2006/0283070 A1 Dec. 21, 2006

Related U.S. Application Data

(63) Continuation of application No. PCT/EP2004/001330, filed on Feb. 12, 2004.

(30) Foreign Application Priority Data

Jul. 28, 2003 (DE) ..... 103 34 340
Aug. 5, 2003 (DE) ..... 103 35 821

(51) Int. Cl.
*F41G 1/387* (2006.01)

(52) U.S. Cl. ..... 42/124; 42/148

(58) Field of Classification Search ..... 42/124–127, 42/90, 111, 146, 148, 106
See application file for complete search history.

(56) References Cited

U.S. PATENT DOCUMENTS 2,475,383 A * 7/1949 Foster ..... 42/16
2,567,535 A * 9/1951 Willis et al. ..... 42/127
2,710,453 A * 6/1955 Beverly ..... 42/128

(Continued)

FOREIGN PATENT DOCUMENTS

DE 25 32 337 1/1977

(Continued)

OTHER PUBLICATIONS

International Search Report for PCT/EP2004/001330, Jan. 18, 2005, 3 pages.

(Continued)

*Primary Examiner*—Michael J. Carone
*Assistant Examiner*—Stewart T Knox
(74) *Attorney, Agent, or Firm*—Hanley, Flight & Zimmerman, LLC

(57) ABSTRACT

An accessory mounting device for use with firearms is disclosed. The mounting device includes a first pin having a first head and a second pin having a second head, wherein the second head projects radially beyond the second pin only on one side of the second pin. The device further includes first and second apertures to receive the first and second pins, respectively, and a first undercut associated with the first aperture, wherein the first undercut is compatible with the first head and a second undercut associated with the second aperture, wherein the second undercut is compatible with the second head. Also included is a spring-loaded locking device attached to the second pin and a handle associated with the spring-loaded locking device. The handle moves the second pin against the force of the spring axially in the direction of the second head so that when the second pin is turned by the handle, the second head pushes against the force of the spring on the second undercut.

23 Claims, 6 Drawing Sheets

U.S. PATENT DOCUMENTS

| | | | | | |
|---|---|---|---|---|---|
| 2,937,448 | A | * | 5/1960 | Dimick | 42/126 |
| 2,942,346 | A | * | 6/1960 | Staubach | 42/127 |
| 3,877,166 | A | * | 4/1975 | Ward | 42/127 |
| 4,205,473 | A | * | 6/1980 | Wilson | 42/127 |
| 4,216,600 | A | * | 8/1980 | Brueckner et al. | 42/127 |
| 4,353,180 | A | * | 10/1982 | Wilson | 42/127 |
| 4,845,871 | A | * | 7/1989 | Swan | 42/127 |
| 5,070,637 | A | * | 12/1991 | French | 42/122 |
| 5,101,590 | A | * | 4/1992 | Hawkins | 42/111 |
| 5,276,988 | A | * | 1/1994 | Swan | 42/127 |
| 5,375,361 | A | * | 12/1994 | Rustick | 42/125 |
| 5,390,419 | A | * | 2/1995 | Sirkis | 42/127 |
| 5,467,552 | A | * | 11/1995 | Cupp et al. | 42/125 |
| 6,026,580 | A | * | 2/2000 | LaRue | 42/127 |
| 6,442,883 | B1 | * | 9/2002 | Waterman et al. | 42/124 |
| 6,606,813 | B1 | * | 8/2003 | Squire et al. | 42/90 |
| 6,678,988 | B1 | * | 1/2004 | Poff, Jr. | 42/147 |
| 7,036,261 | B2 | * | 5/2006 | Murello | 42/127 |
| 7,096,620 | B2 | * | 8/2006 | Zeh | 42/124 |
| 7,272,904 | B2 | * | 9/2007 | Larue | 42/127 |
| 2006/0207156 | A1 | * | 9/2006 | Larue | 42/127 |

FOREIGN PATENT DOCUMENTS

| | | |
|---|---|---|
| DE | 41 33 242 | 10/1992 |
| DE | 94 06 408 | 7/1994 |

OTHER PUBLICATIONS

English Translation of International Exam Report for International Patent Application Serial No. PCT/EP2004/001330, Feb. 12, 2004, 2 pages.

International Preliminary Report on Patentability for PCT/EP2004/001330, Jun. 22, 2006, 6 pages.

* cited by examiner

ACCESSORY MOUNTING DEVICES FOR FIREARMS AND METHODS OF MOUNTING THE SAME

RELATED APPLICATION

This patent is a continuation of International Patent Application Serial No. PCT/EP2004/001330, filed Feb. 12, 2004, which claimed priority to German Application Nos. 103 34 340.7 and 103 35 821.8, filed on Jul. 28, 2003, and Aug. 5, 2003, respectively. The International Patent Application and the German Applications are hereby incorporated herein by reference in their entireties.

TECHNICAL FIELD

This disclosure relates generally to firearms, and, more particularly, to accessory mounting devices for firearms and methods of mounting the same.

BACKGROUND

In conventional, steel-cased firearms, it is common to affix accessory mounting devices directly to the steel casing so that accessories such as, for example, telescopic sights, may be mounted to the firearm. These conventional accessory mounting devices are often very complicated and generally not very durable. Cheaper assemblies such as, for example, extension mounts having clamping jaws that are clamped on a prism rail, also have deficiencies. These extension mounts are not able to be removed and reattached to a firearm in substantially the same position, i.e., a sort of hysteresis occurs in which the shape of the mounting device alters such that the mounting device never assumes the same position it had during the original mounting. When the mounting device does not fit securely on the casing, there is marginal movement, or play. This may seriously affect the accessory of the firearm if the accessory coupled to the mounting device is, for example, a telescopic sight.

Military weapons are even more sensitive to the deficiencies of conventional mounting devices because military assemblies must withstand considerable impacts without the positions of any accessories, mounting devices or other components shifting. For example, with an accessory or mounting device that is mounted on a machine gun, which itself is mounted on an all-terrain vehicle, all components must maintain a stable arrangement during use to ensure proper and reliable continued use. Military assemblies must also transfer and support great forces such as, for example, when the assemblies are connected not only to a relatively light telescopic sight, but also to heavy combat lenses, combat electronics, or to secondary weapons such as grenade launchers. Nevertheless, military assemblies should be simple, cost-effective, compact and readily and conveniently attachable and detachable.

In practicality, assemblies are interfaces that must adhere to strictly defined positions with respect to the arrangement of all of the components of a weapon as well as in general use in all types of devices. The interfaces should also permit simple detachment and reattachment, without ever compromising the defined position assignment in any way.

A known military telescopic sight for sharpshooter guns from the former German Democratic Republic includes two pins attached to the telescopic sight that each correspond to pin sockets on the gun—one in front and one behind the lock. To mount the telescopic sight to the weapon, the telescopic sight is held at a diagonal to the bore axis. Then the front pin is placed in the front socket, and the telescopic sight is then pivoted by 90° until the telescopic sight is parallel to the bore axis. During the rotation, a projection of the front pin engages an undercut in the front socket, and the rear pin locks laterally into the rear socket. For detachment, the activation of a handle on the rear socket releases the rear pin, and then the telescopic sight is again pivoted by 90° such that the telescopic sight can then be lifted out of the front socket.

A major deficiency to this mounting device is that it requires an exact integration of all parts and, thus, is useful in only a very particular case. Requiring such a precise arrangement renders impossible the interchangeability of the telescopic sight or other accessory devices. Furthermore, such a stringent requirement is incompatible with standard manufacturing tolerances of the components of the weapon and the accessory mounting device. In addition, because the pins are separated by a relatively large distance, the sockets are individually attached to the weapon so they can be spaced a distance that will minimize any tolerance. However, this requires the weapon to be massive enough to accommodate these variable components.

Two other pivoting mechanisms are described in German Patent DE 94 06 408 U and U.S. Pat. No. 4,205,473. In the German patent, the pin is pivotable with a pivoting lever and is attached to the mounting device through a center countersunk screw and spring-mounted shaft washer. The U.S. patent also shows a telescopic sight mount, in which the pivotable pin is mounted by means of a rotary screw.

DETAILED DESCRIPTION

In general, the present disclosure relates to a mounting device that forms an interface between a device, in particular a weapon, and an accessory. The mounting device includes two or more pins and two or more bore holes, or apertures, which have undercuts and which serve as sockets for the pins. The mounting device includes a locking device that is cushioned by a spring and that is attached to one of the pins and operated by a handle. The undercuts of two apertures are either designed on the sides facing away from each other and/or on the sides facing toward each other. The undercuts of the apertures are sloped, and the pins bear heads that are designed to be compatible with the sloped undercuts. Operation of the handle turns one of the pins, whereby the head of this pin only radially extends beyond the corresponding undercut on one side.

As shown in FIGS. 1-4, the example mounting device 102 includes of a weapon-side component 104 and an accessory-side component 106, which can be assembled together or separately. In general, the weapon-side component 104 may be permanently attached to a weapon or to a device by any known mechanical or chemical means such as, for example, a screw. Further, the accessory-side component 106 may be selectively or removably coupled to the weapon-side component through a pivoting pin 124, which is discussed in greater detail below.

Figure 4:
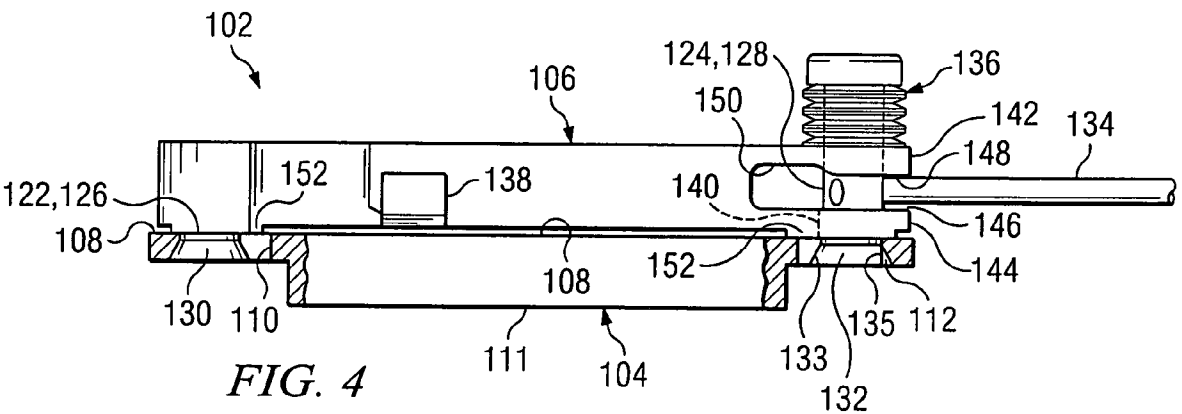
FIG. 4 shows a partial cross-sectional side view of the example unlocked accessory mounting device of FIG. 2.
Figure 5A:
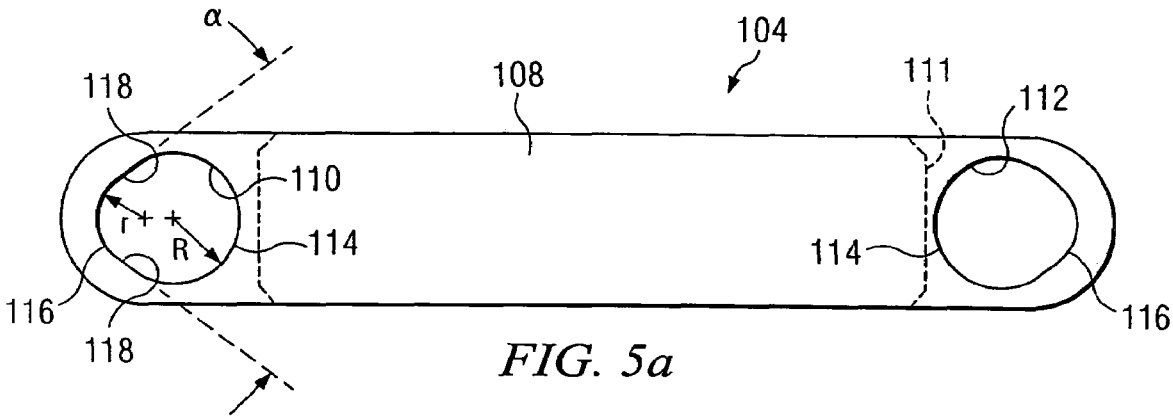
FIG. 5*a* shows a detailed top view of example apertures of the example accessory mounting device of FIG. 1.
Figure 5B:
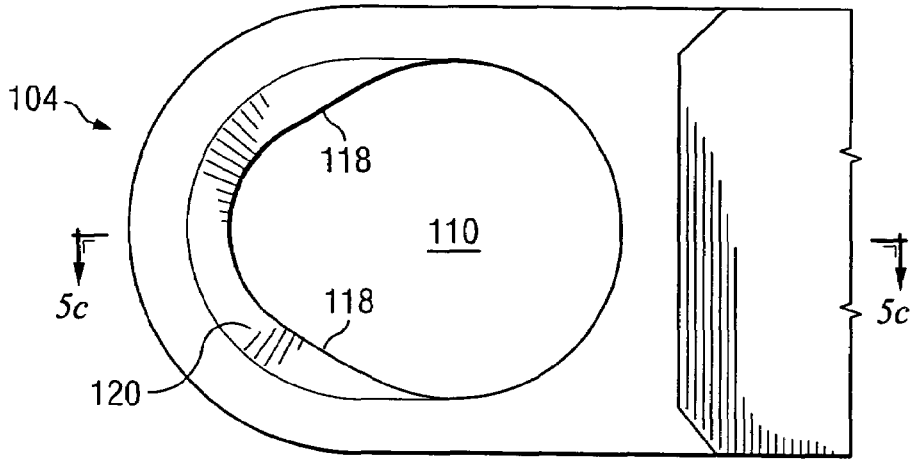
FIG. 5*b* shows an enlarged detailed view of the bottom of one of the example apertures of FIG. 5*a*.
Figure 5C:
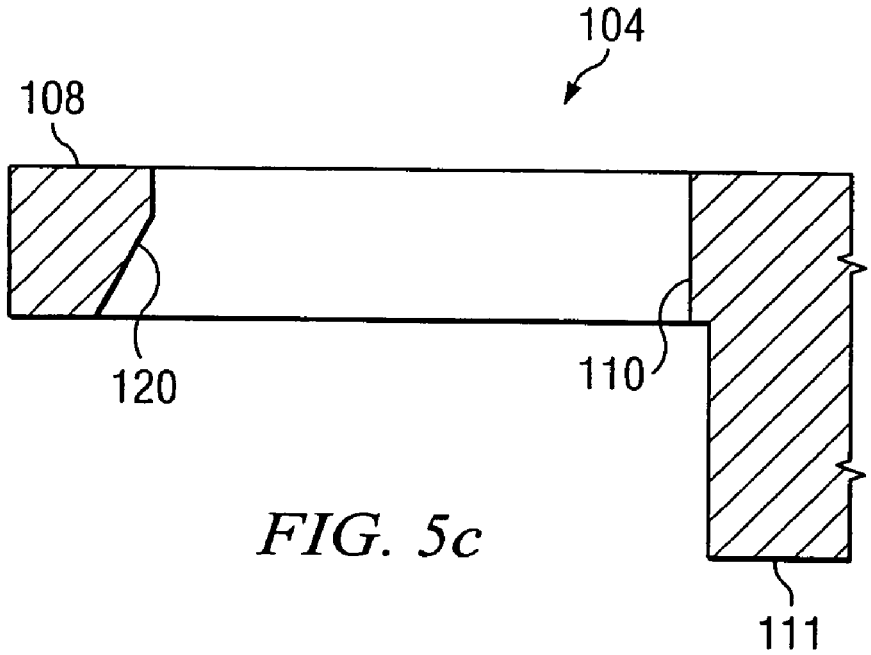
FIG. 5*c* shows a longitudinal cross-sectional view of the example aperture taken along lines 5*c*-5*c* in FIG. 5*b*.

The weapon-side component 104 has a smooth mounting surface 108 and is penetrated by two bore holes or apertures 110, 112, which are spaced from and perpendicular to the surface 108 and, thus, parallel to each other (FIG. 4). Each of these apertures 110, 112 have a non-circular cross-section and are similarly shaped, but, according to one example, are mirror images of each other (FIGS. 5*a*-5*c*).

The profile of each aperture 110, 112 includes a cylindrical bore hole section 114 with a radius R, which is expanded by an axially parallel, eccentric section 116, which has a radius r, where R>r. Both bore hole sections 114, 116 are connected by tangent surfaces 118, which preferably involve an angle, $\alpha$, that is approximately 30° to the center axis in the direction of the eccentric section 116. The smaller eccentric sections 116 each lie on the sides of the cylindrical sections 114 that are turned away from each other. The apertures 110, 112 are thus symmetrical to each other. Alternatively, th e eccentric sections 116 may each lie on the sides of the cylindrical sections 114 that are turned toward each other, which also provides a symmetric relationship between the apertures 110, 112.

On the bottom side of the weapon-side component 104 facing the observer in FIGS. 1 through 3 and 5*b*, the eccentric section 116 is countersunk conically, which creates an undercut 120 that tapers out into the tangent surfaces 118. This is shown in FIG. 5*c*.

The accessory-side component 106 may include a fixed pin 122 and an axially movable and pivotable pin 124. In one example, the pins 122, 124 are substantially parallel to each other. Each pin 122, 124 has a respective shaft 126, 128 as well as a respective head 130, 132 on its free end. The shafts 126, 128 are cylindrical and have radii that are each greater than r, the radius of the eccentric section 116 of the apertures 110, 112, and smaller than R, the radius of the cylindrical section 114 of the apertures 110, 112. With respect to the fixed pin 122, the shaft 126 ends at a conical frustum-shaped head 130. The angled portion of the head 130 complements the undercut 120 created by the conical countersink of the apertures 110, 112. The head 130 expands from the shaft 126 towards the weapon-side component 104.

Figure 1:
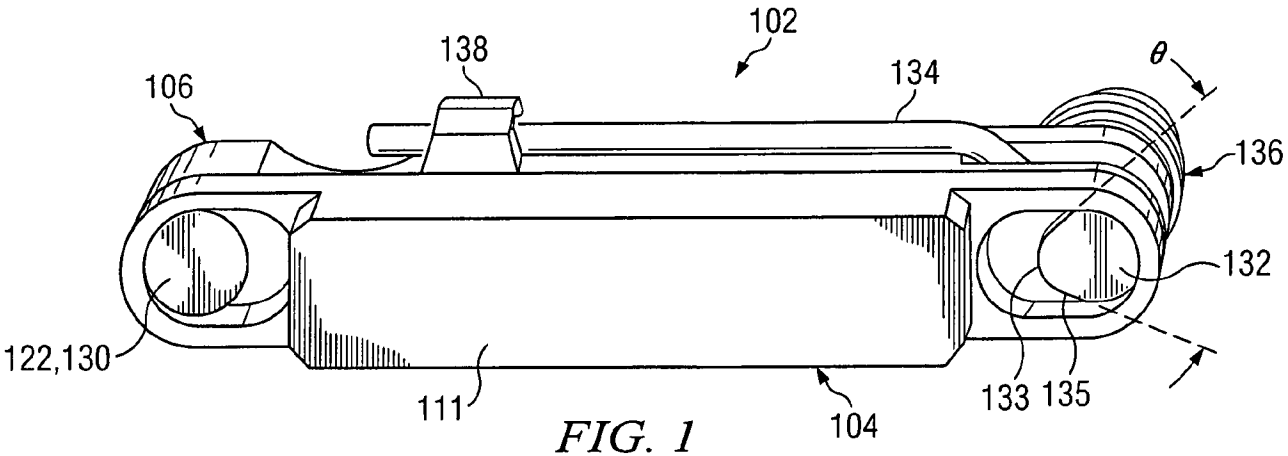
FIG. 1 shows an isometric view of an example accessory mounting device including weapon-side and accessory-side components mated and locked.
Figure 2:
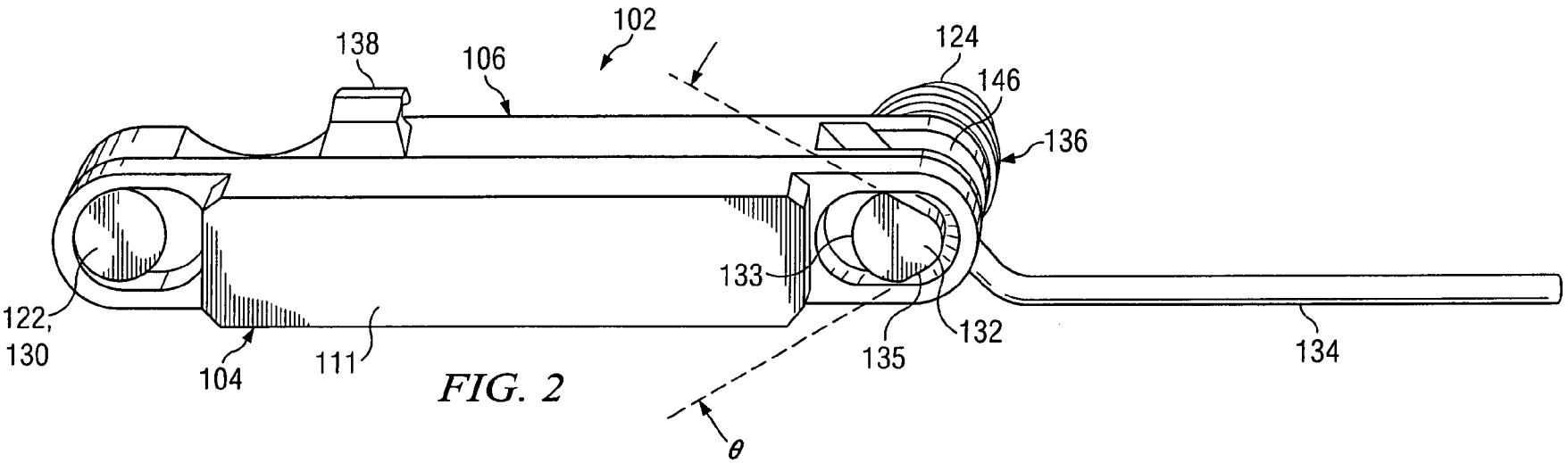
FIG. 2 shows the example accessory mounting device of FIG. 1, wherein the weapon-side component is mated to the accessory-side component, but is not locked.
Figure 3:
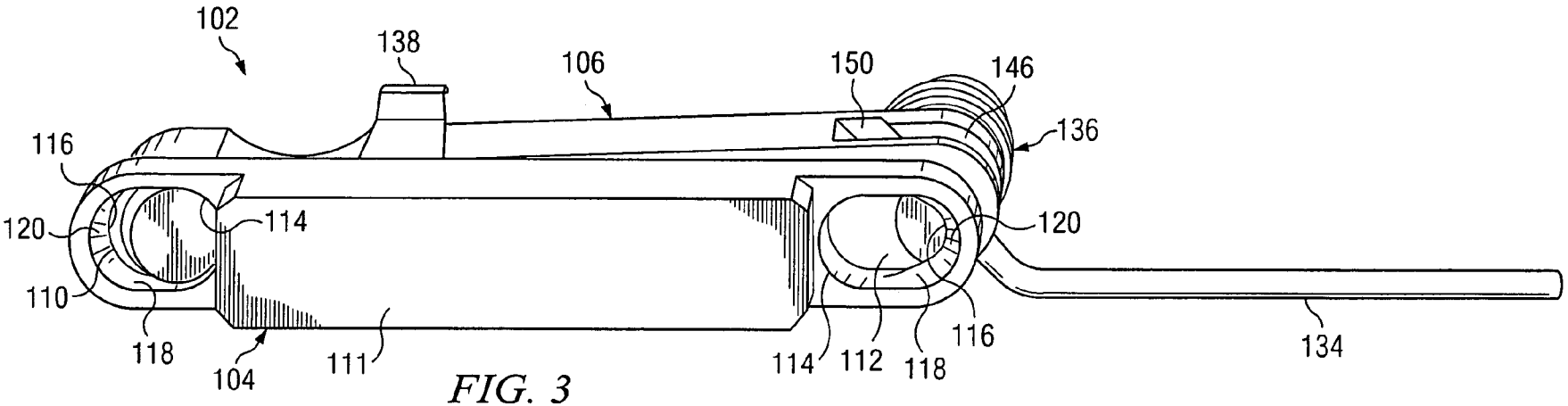
FIG. 3 shows the example accessory mounting device of FIG. 1, wherein the weapon-side component and the accessory-side component are not mated or locked.

When the fixed pin 122 sits in the associated aperture 110 and the mounting device 102 is completely locked (FIG. 1), the conical-frustum-shaped head 130 engages the undercut 120. If the mounting device is unlocked (FIG. 2), the head 130 may still engage the undercut 120, but the head 130 is movable within the aperture 110 such that the head 130 may be moved so as to not engage the undercut 120 (FIG. 3). Also, as shown in FIGS. 1-3, because the fixed pin 122 has a conical-frustum shaped head 130, the bottom of the head 130 has a circular shape. Furthermore, the head 130 and the undercut 120 in the aperture 110 form two engagement surfaces, which are generatrices formed at the tangent surfaces 118 of the undercut 120.

The head 132 of the rotatable pin 124 has a similar geometrical designed as the head 130 of the fixed pin 122, namely, the head 132 has a beveled surface 133. However, a flat portion 135 of the head 132 is truncated and does not have a beveled surface. The flat portion 135 runs along two planes, which together form an angle, $\theta$, which is approximately 90°. The angle, $\theta$, is rounded along the perimeter of the rotatable pin 124 (FIGS. 1 and 2).

The rotatable pin 124 can be turned 180° by means of a handle 134. When the handle 134 is turned toward the fixed pin 122 (FIG. 1), the head 132 is positioned such that two generatrices or surfaces of the beveled edge 133 and the undercut 120 in the aperture 112 engage. When the handle 134 is completely extended away from the fixed pin 122 (FIGS. 2-4), the head 132 is rotated so that the flat portion 135 is turned toward the undercut 120 and, thus, there is no engagement between the head 132 and the undercut 120.

When the mounting device 102 is in the locked position (FIG. 1), the rotatable pin 124 is turned such that the distance between the pins 122 and 124 is greater than the distance between the apertures 110, 112. This is due to the fact that the head 132 assumes its end position with the beveled edge 133 engaging the undercut 120, i.e., the head 132 moves a bit toward the observer (toward the right in FIG. 1). This occurs by pressing together a disk-spring package 136, i.e., the head 132 of the rotatable pin 124 pushes against the force of the spring 136 on the sloped undercut 120 of the aperture 122.

When the mounting device 102 is locked, or fully assembled, the handle 134 pivots from the position in FIG. 2 by 180° into the position in FIG. 1, where the handle 134 engages with a notching 138. This engagement is achieved through the self-springing of the handle 134 and mainly through the tangential deviation or rotation of the rotatable pin 124 against the effect of the disk-spring package 136.

The pin 124 is positioned in a bearing 140 such that the pin 124 has a certain range of movement within the bearing 140 and only sits along two generatrices of the bearing 140, when the head 132 is in the position in FIG. 1. As shown in greater detail in FIG. 4, the accessory-side component 106 is forked on the end accommodating the rotatable pin 124. The accessory-side component 106 and has a fork branch 142 facing away from the weapon-side component 104, "top fork branch 142," and a fork branch 144 facing the weapon-side component 104, "the bottom fork branch 144." Each fork branch 142 and 144 is provided with an aperture (not shown) that accommodates the rotatable pin 124. The aperture in the top fork branch 142 has the same shape and alignment as the aperture 112 in the weapon-side component 104, however without having an undercut. The aperture in the bottom fork branch 144 also has the same shape, but is turned by 180°. Thus, apertures with the large radius R and apertures with the small radius r alternate from the accessory-side component 104 in the direction of the weapon-side device 106. Therefore, when the mounting device 102 is mounted (FIGS. 1 and 2), the rotatable pin 124 lies in the aperture of each fork branch 142, 144 along two axially parallel engagement surfaces, whereby, from aperture to aperture, the two engagement surfaces are offset mainly by 180°.

The handle 134 is guided out of the accessory-side component 104 by a radial slit 146. This radial slit 146 is confined by a radial surface 148 along the bottom surface of the top fork branch 142. The force generated by the spring 136 pushes the rotatable pin 124 upwards and causes the handle 134 to sit against the radial surface 148 (FIGS. 2, 3, 4). As the mounting device 102 is locked, the handle 134 is moved along the radial surface 148 until the handle 134 reaches a recess 150. At this point, the engagement of the handle 134 and the radial surface 148 no longer prevents further upward movement of the rotatable pin 124 due to the tension in the spring 136. The handle 134 can move in the recess 150, which enables greater travel of the spring 136. Because movement of the handle 134 in the recess 150 is not limitless, the spring 136 always remains, to some extent, pretensioned. Further, when the handle 134 is outside the recess 150, the head 132 of the rotatable pin 124 may be above the undercut 120 as shown in FIG. 3.

A marksman always has the handle 134 in his line of sight and can react immediately should the handle 134 not have engaged with the notching 138. This ensures that the marksman can easily identify when the mounting device 102 is in the locked state and, thus, ensuring that any accessories mounted thereto are secure.

The accessory-side component 104 also has overlapping surfaces 152, which run complementarily to the mounting surface 108 and ensure the good seating of components 104 and 106 on each other.

Figure 6:
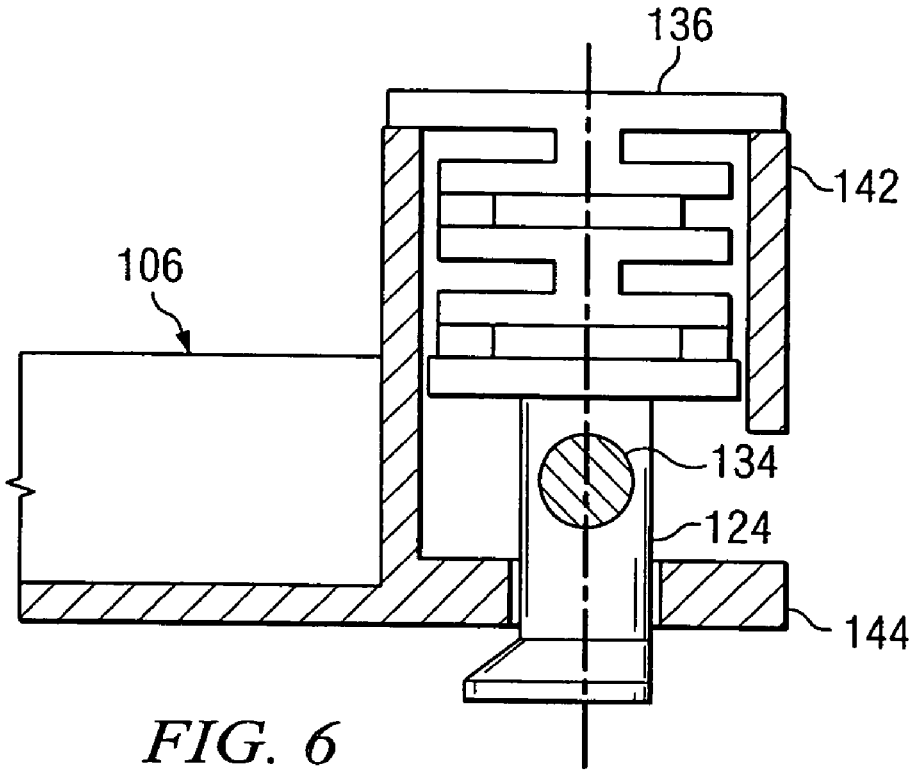
FIG. 6 shows a cross-sectional view of an alternative example movable pin in an example accessory mounting device.

FIG. 6 shows an alternative design in which the rotatable pin 124 and the spring 136 are connected as one piece. Operation of the example mounting device 102 of FIG. 6 is substantially the same as the example of FIGS. 1-4.

Figure 7A:
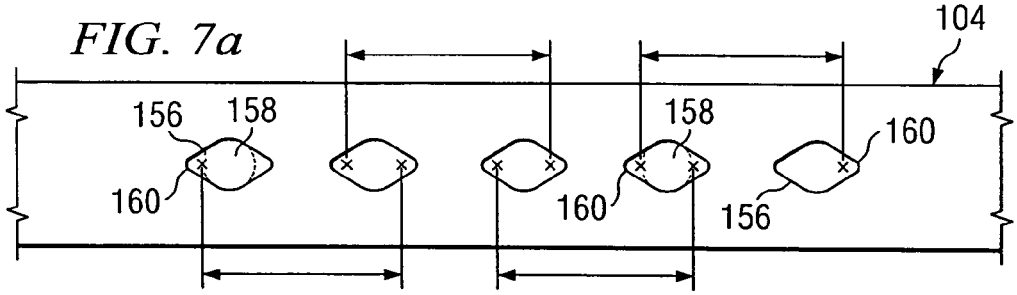
FIGS. 7*a* and 7*b* show a top view of alternative example apertures of an example accessory mounting device.
Figure 7B:
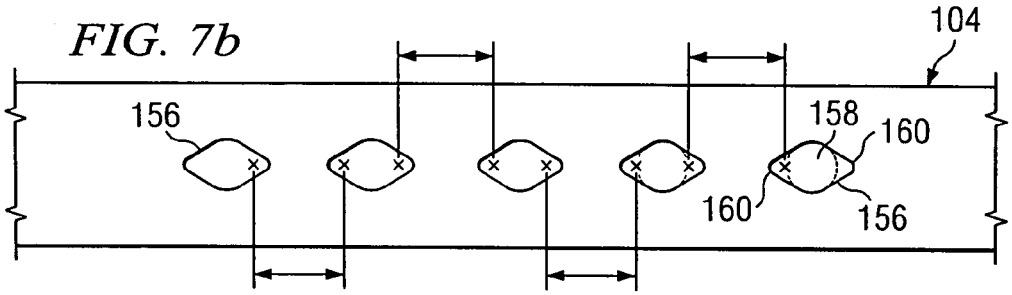

FIGS. 7*a* and 7*b* show another alternative example, in which several apertures 156, (in this case, 5 apertures) are provided on the weapon-side component 104. The profile of each aperture 156 includes a cylindrical section 158 with a radius R (not shown), which is expanded by an axially parallel, eccentric section 160, which has a radius r (not shown), where R>r. Both aperture sections 158, 160 are connected by tangent surfaces (not shown). The smaller eccentric sections 160 lie on each side of the cylindrical sections 158. On the bottom side of the weapon-side component 104, the eccentric sections 160 are countersunk conically, which creates undercuts (not shown) that taper out into the tangent surfaces. Thus, each aperture 156 has two undercuts in the direction of their neighboring aperture 156. Even the outer-lying apertures 156 have undercuts, which face the outside, i.e. face away from each other. The two pins 122 and 124 of the accessory-side component 106 can now be inserted into any two, preferably neighboring apertures 156 (but if necessary even with some intermediate apertures 156), whereby the accessory-side component 106 can be mounted in different positions on the weapon-side component 104. Through the "double-sided" design of the undercuts in the individual apertures 156, the two apertures 156 with inserted pins 122 and 124 are stressed either with pull (FIG. 7*a*) or with push (FIG. 7*b*) depending upon the corresponding orientation and separating distance of the pins 122 and 124.

Naturally, more than one fixed and/or movable pin 122 and 124 can be provided, which are accommodated in several apertures 156 when the accessory-side component 106 is mounted on the weapon-side component 104. For example, a triangle of forces can be stretched with two fixed and one movable pin, a parallelogram of forces with a number that is correspondingly higher, etc.

Figure 8:
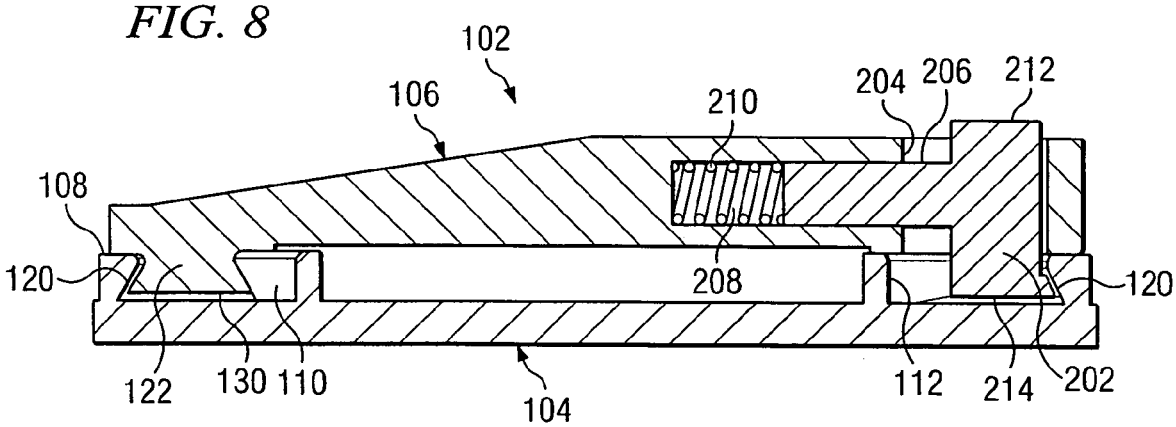
FIG. 8 shows a longitudinal cross-sectional view of an alternative example accessory mounting device in a permanently mounted state.

FIG. 8 shows yet another alternative example mounting device 102, in which, in contrast to the first example mounting device 102 shown in FIGS. 1 through 5, the mounting device 102 of FIG. 8 is not locked and unlocked by turning a handle but rather by pushing the movable pin 202. FIG. 8 shows components similar to those in FIGS. 1 through 5 with the same reference numbers. For their description, refer to the above description of the first example mounting device 102. Only the components that differ from the first example mounting device 102 are described here.

The example mounting device 102 of FIG. 8 includes a movable pin 202 that can be moved in its longitudinal direction, which—guided by a recess 204—can be pushed towards and away from the fixed pin 122. The movable pin 202 is integrally connected with a guiding rod 206 that sticks out radially, which is guided in a recess 208 and is pretensioned by a spring device 210 in the direction away from the fixed pin 122, i.e., such that the head 214 is biased toward the undercut 120 in the aperture 112. The top end 212 of the movable pin 202 sticks out a bit from the top side of the mount-side interface 106, whereby this projecting end 212 serves as a handle for operating the mounting device 102. As shown in FIG. 8, in the second example mounting device 102, the apertures 110 and 112 in the weapon-side component 104 and the heads 130 and 214 of the respective pins 122 and 160 in the accessory-side component 106 are designed geometrically like the apertures 110 and 112 and heads 130 and 132 of the first example mounting device 102. In particular, the head 132 of the movable pin 124 is beveled on the side facing the pin 122. In the illustrated example of FIG. 8, the head 214 of the movable pin 202 can, for example, be designed exactly like the head 130 of the fixed pin 122, thus, as a circumferential conical frustum.

In order to insert the accessory-side component 106 into the weapon-side component 104, a user pushes the handle 212 against the force of the spring device 210 in the direction of the fixed pin 122 and inserts the two pins 122 and 202 into the corresponding apertures 110 and 112. Then he releases the handle 212, whereby the movable pin 202 moves away from the fixed pin 122 due to the spring force. The respective beveled edges of the heads 130 and 214 thereby push on the undercuts 120 of the apertures 110 and 112 and pull the accessory-side component 106 to the weapon-side component 104. At the same time, the two pins 122 and 202 are tensioned against each other under the undercuts 120. To open or unlock the mounting device 102, the user only needs to move the handle 212 in the direction of the fixed pin 122, whereby the heads 130 and 214 are released from the undercuts 120, and then demount the accessory-side component 106 from the weapon-side component 104.

The two mounting devices 102 in accordance with the example of FIGS. 1-5 and the example of FIG. 8 generally have the same applications. However, because the spring device 210 is preferably dimensioned with a lower spring force, to still ensure a light manual opening of the handle 212, the illustrated example mounting device 102 of FIG. 8 is preferably suitable for lighter accessory-side components. Alternatively, a lever mechanism for pushing the handle 212 could also be provided, whereby the spring device 210 can be designed to be stronger and the mounting device 102 can also hold heavier accessory-side components.

In yet another alternative example, the moveable pin 202 may be design to be pretensioned in the direction of the fixed pin 122. For this, the undercuts 120 of the apertures 110 and 112 would have to lie opposite each other or each of the apertures 110 and 112 would have to have two undercuts 120, as discussed above with respect to FIGS. 7*a* and *b*.

In all of the illustrated examples, it can be advantageous to install the mounting device 102 such that the fixed pin 122 lies toward the back of the weapon and, thus, the rotatable pin 124 or the movable pin 202 lies in the front in the direction of fire and is tensioned for locking the mounting device 102 in the direction of the fixed pin 122. This configuration places pressure on the weapon-side component 104 and, thus, the locking spring 136 or 210 is not stressed during a shot. To make mounting easier and for more freedom of design, the handle 134 in the first illustrated example can be decoupled from the locking mechanism (the pin 124 and spring 136) such that it no longer makes any sort of stroke movements.

Figure 9:
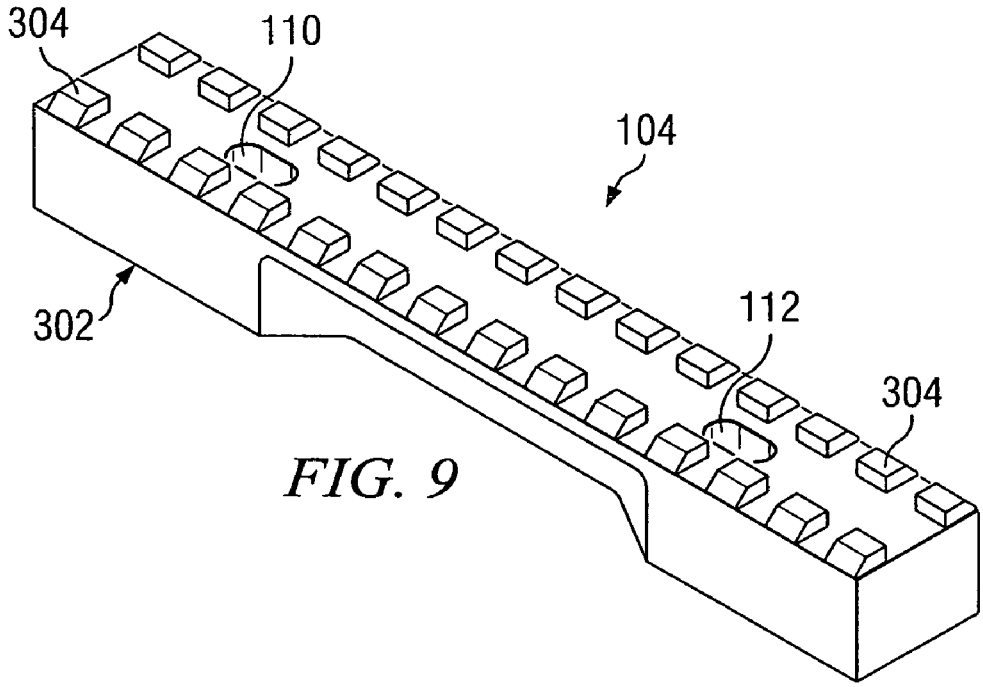
FIG. 9 shows an isometric view of the weapon-side component of the mounting device, which is integrated in a Picatinny rail.

FIG. 9 shows an alternative example wherein a Picatinny rail 302 is used as the weapon-side device component 104. As shown in FIG. 9, the Picatinny rail 302 includes integrated apertures 110 and 112. There are ridges 304 running diagonal to the longitudinal direction of the Picatinny rail 302 and accommodating apertures 110 and 112 are, thus, designed to be wider in the longitudinal direction. Naturally, the wider design depends on the dimension of the apertures 110 and 112 and the width of the ridges 304.

Figure 10:
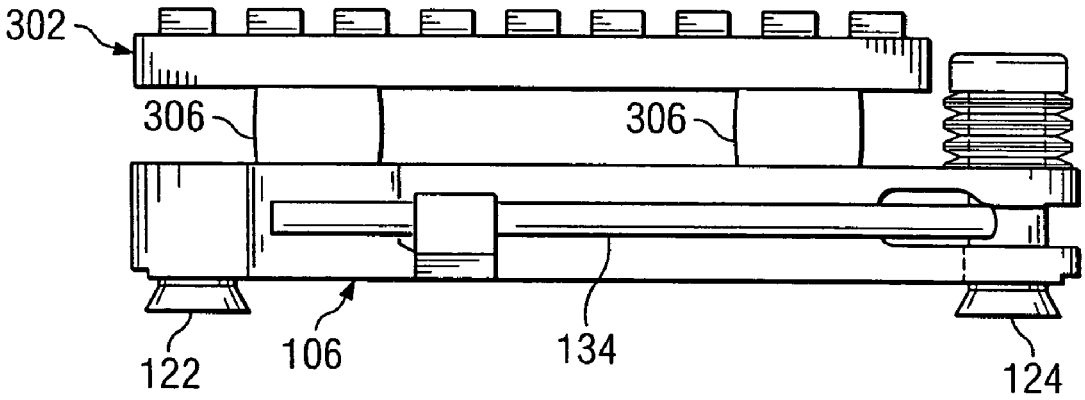
FIG. 10 shows a side view of the accessory-side component of the mounting device, which bears a Picatinny rail.

FIG. 10 shows the integration of the Picatinny rail 302 into the accessory-side component 106. As can be seen in this figure, the Picatinny rail 302 is permanently connected to the accessory-side component 106 via two spacers 306 (preferably integrated with the rail 302) and runs parallel to the longitudinal direction of the rail 302.

Naturally, the mounting device 102 can be used in accordance with the above illustrated examples to connect any two functional components. For example, an assault handle, a shoulder rest, an additional magazine, etc. can be connected to the weapon in a detachable manner. In the exemplary embodiments shown in FIGS. 9 and 10, other interfaces common for weapons can also be provided as an alternative to the Picatinny rail 302. Further, the alternative interfaces may be permanently or temporarily mounted to the weapon.

As described above, known mounting devices are not durable, are unable to withstand high forces, and do not enable the attachment, detachment and reattachment of accessories with consistency, especially in terms of solidity and stability of the connections. The illustrated examples presented herein at least partially reduce the deficiencies in the known mounting devices. As detailed herein, the configuration of the example mounting device 102 provides the needed stability and durability. Particularly beneficial is that one of the pins 124 can be moved against the force of the spring 136 axially in the direction of the head 132, so that when this rotatable pin 124 is turned by means of the handle 134, the head 132 pushes against the force of the spring 136 on the sloped undercut 120 of the associated aperture 112, to which the head 132 has a complementary design.

As already noted, the example mounting device 102 is designed in particular for the attachment of accessory devices to a weapon, but can also serve for the exact positioning and separable joining together of all types of devices. The term "accessory device" is preferably understood to mean a combat array processor, target scope, target electronics (e.g. telescopic sight, night target device, laser target device), a second weapon (e.g. accessory grenade launcher, rapid fire gun), or any other supplemental components or apparatus that is attachable for use with the underlying device.

A sloped "undercut" is understood to mean an enlargement of the bore hole or aperture diameter that is present on the outside mouth of the aperture, whereby the term "sloped" describes a generally continuous transition (conical, parabolic, hyperbolic, bossed or otherwise) from the inner to the outer mouth.

"Handle" is understood to mean an actuation device for power admission, like a lever, but it can also be a servo-motor or the like, if necessary.

"Head" is understood to mean a radial end projection of the pin. In special cases, the pin can also extend beyond the head.

Returning to the example illustrated in FIGS. 1-5, the two apertures 110, 112 are preferably designed on the weapon-side component 104 or attached to it and, preferably to a weapon (e.g., a hand gun), while the pins 122, 124 are associated with the accessory-side component 106. Further, like the handle 134 is associated with one of the pins 122, 124, in particular, in the illustrated e.g., to the rotatable pin 124.

The apertures 110, 112 (exclusive of the undercuts) preferably have a radius that is smaller than the radius of the pins 122, 124 (exclusive of the heads). It is not required that the pins 122, 124 be placed in the apertures 110, 112 in the direction of their axes. Rather, it is preferred that the opposite radii of the apertures 110, 112 and that of the pins 122, 124 do not match, and instead is coordinated such that the radii of the pins 122, 124 is a bit larger than that of the apertures 110, 112. Thus, the fixed pin 122 is inserted into the associated aperture 110 in a sloped manner and the head 130 is hooked behind the undercut 120. The aperture 110 must be large enough to let the head 130 of the fixed pin 122 pass through if the fixed pin 122 is slightly angled. The accessory-side component, 106 which usually carries the pins 122, 124, is then pulled in the direction of the fixed pin 122, until the rotatable pin 124 can engage with its associated aperture 112. The head 132 of the axial and pivotable pin 124, 202 must hereby have a pivoting position such that this rotatable pin 124 can now also engage with its associated aperture 112. Both pins 122, 124 now sit in their respective apertures 110, 112.

Now the rotatable pin 124 is turned by means of the handle 134 and pushes against the slant of the undercut 120. The head 130 of the fixed pin 122 thereby presses against the undercut 120 of the associated aperture 110. When the handle 134 is turned further, the rotatable pin 124 is moved axially against the force of the spring 136 because the head 132 of the rotatable pin 124 engages the undercut 120 in the aperture 112. When turned further, the head 132 thereby dips a bit into the associated aperture 112 until the head 132 has reached its final position and fully engages the undercut 120.

The term "compatible" hereby means that the undercut 120 and the head 132 must be designed such that the movement of the rotatable pin 124 described above is possible. In practice, the sloped surfaces on the undercut 120 and on the head 132 are designed complementarily or almost complementarily.

When using a spring 136, the spring 136 provides for the constant pressure, with which the pins 122, 124 are pushed into the apertures 110, 112. The fixed pin 122 is forced downward in the aperture 110 by the slant of the undercut 120, while the rotatable pin 124 is held downward in the aperture 112 by the force of the strong spring 136.

It is thereby preferred to design the surfaces of the heads 130, 132 of the pins 122, 124 approximately complementarily to the surfaces 114, 116, 118, 120 around the apertures 110, 112 such that a level surface is formed perpendicular to the respective axes.

In the end, it does not matter how far the rotatable pin 124 may or may not have moved axially. Rather, it is important that the rotatable pin 124 transfers the force exerted by the locking device, in particular the spring 136, via the head 132 to the associated undercut 120. When using a spring 136, the example mounting device 102 is suitable for accommodating considerable tolerances, in contrast to known pin assemblies, which would have to be fine-tuned. For this reason, the example mounting device 102 is particularly suited for a variety of accessory devices and ensures their secure attachment without any marginal movement or wiggling.

In the example mounting devices described herein where the undercuts 120 are turned away from each other, the associated apertures 110, 112 can be constructed in a thin-walled housing of a weapon because the attached accessory-side component 106 exerts a force that pulls the apertures 110, 112 apart. A sheet-metal wall, which runs in a straight line between the apertures 110, 112, can accommodate very high forces between the two apertures 110, 112 without deforming. Further, both apertures 110, 112 can be designed symmetrically to each other, i.e. by means of the same tools. This enables a reduction in the cost of manufacture of the example mounting device 102.

The heads 130, 132 can sit flat below the undercuts 120. This ensures that the surfaces that are in contact with each other wear away as little as possible. However, great production accuracy and meticulous cleanliness are both required. In particular, the complementary, engaging surfaces should have no corrosion or contamination. To avoid such problems, one example mounting device 102 suggests that each of the heads 130, 132 sits against the undercuts 120 along two engagement surfaces. Thus, the pins 122, 124 via the heads theoretically lie against the undercuts 120 only in duplicate line tangencies, which ensures the best reproducibility of the position of the pins 122, 124 relative to the apertures 110 112.

The following example explains this geometry in greater detail. Consider the radial section (in terms of the aperture 110 and the fixed pin 122) in the area of the undercut 120 once the mounting device 102 has been completely installed. The aperture 110 has a circular circumference portion 114, which is interrupted by a circular extension arc 116 with a smaller radius extending toward the outside. The transition from the circle with the larger radius 114 to the circular arc with the smaller radius 116 theoretically occurs in a tangent surface, or edge 118. Each edge 118 can be broken by a tangent placed on both circles 114, 116. The wrap angle of the segment 114 of the circle with the larger radius is larger (which is, for e.g., 240°) than the wrap angle of the segment 116 of the circle with the smaller radius (which is, for e.g., 120°). Further, the fixed pin 122 and the head 130 have circular cross-sections. The radius of the head 130 of the fixed pin 122 is slightly smaller than the larger radius of larger circle segment 114 of the enter aperture 110 and much larger than the smaller radius of the smaller circle segment 116 of the aperture 112. Both radii of the fixed pin 122 and the head 130 have the same center point and the radius of the head 130 must be larger. The head 130 spans across an angle range wider than the angular distance between the two edges 118. Consequently, when the accessory mounting device 102 is locked, two almost axially parallel engagement surfaces of the fixed pin 122 or head 130 can form on the sloped undercut 120 at the edges 118. Furthermore, when installing or detaching the accessory-side component 106, the head 130 can engage with the circular section 114 of the aperture 110 with the larger radius (e.g. the angle range is approximately 60°). When the mounting device 102 is finally installed, the head 130 lies firmly in the undercut 120 in the radial direction, namely along the aforementioned edges 118, which in practice, is along two narrow engagement surfaces diagonal to the aforementioned tangents.

A small separation distance develops on both sides of these engagement surfaces between the surfaces of the undercut 120 and the head 130, so that the contamination or slight corrosion can be cleared towards this separation distance and does not become anchored or imbedded, which would compromise the accuracy of the position reproduction of the accessory-side component 106.

Though the example described immediately above reference the fixed pin 122, head 130 and aperture 110, the configured described may also be used for the rotating pin 124, head 132 and aperture 112, and/or the movable pin 202, head 214 and aperture 112.

The pins 122, 124 can each be attached to the accessory-side component 106 individually (for e.g. by means of two special rings such as, for example, with telescopic sights). However, the accessory-side component 106 must also be able to withstand considerable forces, which are applied to the pins 122, 124 after installation (in this case, force of pressure). To resolve this problem, one illustrated example suggests that the pins 122, 124 sit in or engage one, single special component e.g., the weapon-side component 104. This component 104 can be made of steel, aluminum, a carbon-fiber composite material, etc. and intended for installation with an accessory-side component 106. The illustrated example has a bend-resistant component 104, into which the two pins 122, 124 are inserted and which, despite the forces affecting the pins 122, 124, is stable enough to keep from becoming deformed. The accessory-side component 106 only needs to be supported by the component 104, but does not need to bear any forces besides its own mass force.

Alternatively, an accessory mounting device may be mounted to an existing mounting device. The accessory mounting device may also be specially formed, for example with a cylindrical cavity into which the housing of a telescopic sight can be glued.

The apertures 110, 112 can also be designed e.g. in the housing of a rapid-fire gun, the sheet-metal of which is flanged in around the apertures 110, 112 in order to form the undercuts 120. However, it is preferred that the apertures 110, 112 sit in or are formed in one, single, separate component 104. The bracket 111, which connects the two apertures 110, 112, bears the occurring tractive forces. If the bracket 111, e.g. a steel strip, is placed, e.g. welded, on the housing of a weapon, then the housing wall closes the bottom side (the side of the undercuts 120) of the apertures 110, 112 so that dirt and other contaminants, though they may collect in the apertures 110, 112, cannot get into the mechanism of the gun.

However, this type of closure of the apertures 110, 112 can also be incorporated into the weapon-side component 104. Thus, it is preferred in accordance with one example mounting device that the apertures 110, 112 of the component 104 on the side of the undercuts 120 are at least closed after the installation of the component 104. One sheet can be placed on the component 104, which closes the apertures 110, 112. This closure will prevent moisture from accumulating and corroding the housing. Naturally, the apertures 110, 112 can be open towards the inside of the housing (because, for e.g., a scope may be always mounted on the gun in the operating state which would close the apertures 110, 112 to the outside). This has the advantage of enabling easier cleaning of the apertures 110, 112.

If a thin-walled plastic housing is used, then the component 104 already requires at least one anchoring point, which is fixed with respect to the barrel of the gun. The covering of the apertures 110, 112 prevents dirt or sand that may have penetrated into the apertures 110, 112 from being pressed into the plastic housing wall.

For its pivot and translation movement, the rotatable pin 124 can simply be guided in a transition aperture 112. It is also possible to insert a chuck made of bearing metal or the like into this aperture 112, in order to facilitate movement without having to accommodate marginal movements, or play.

However, exactly the opposite is preferably suggested. It is not simply a question of whether or how small any marginal movement should be, but rather that the example mounting device 102 be configured for greater axial support of the rotatable pin 124. To that end, it is suggested that the accessory mounting device 102 has two bearings 140 for guiding the rotatable pin 124 such that, when the accessory mounting device 102 is installed, the rotatable pin 124 in each bearing 140 creates two mainly axially parallel engagement surfaces with the bearing 140, whereby each of the engagement surfaces of the bearing 140 are offset by mainly 180°.

If the rotatable pin 124 is turned such that its head 132 lies against the undercut 120 and moves axially against the force of the spring 136, then the head 132 preferably sits between the two engagement surfaces, while the rotatable pin 124 is reinforced between two other engagement surfaces in the bearing 140 in the bottom fork branch 144. In additional, there are at least two other engagement surfaces in the aperture of the top fork branch 142. The interaction of the rotatable pin 124 and head 132 and the engagement surfaces described herein strictly defines position of the pin 124, when the head 132 engages the associated undercut 120.

The rotatable pin 124 covers an axial distance against the effect of the spring 136. The spring 136 must thereby be designed such that the spring 136 preserves the fit of the mounting device 102, even if the spring 136 is exposed to considerable mass forces. This can lead to considerable difficulties, for example, if the head 132 of the rotatable pin 124 does not immerge deep enough into the associated aperture 112, so that the head 130 of the rotatable pin 124 can progress along the undercut 120. Thus, it is preferred here that the spring 136 is pretensioned and is only released during the turning of the rotatable pin 124 if the head 132 of the associated rotatable pin 124 is already partially located under the undercut 120 of the associated aperture 112.

The rotatable pin 124 is, thus, always located in a position in which the rotatable pin 124 is already loaded by the spring 136 such that the rotatable pin 124 does not need to perform or only needs to perform a small axial movement during turning. The spring 136 is released towards the end of the turn so that sufficient initial force of the spring 136 is ensured under all circumstances.

The handle 134 could be a lever, which is attached to the rotatable pin 124 in a radially projecting manner. The solution with the lever 134 projecting from the rotatable pin 124 is preferably further developed in that, in the case of a handle 134 that is radially attached to the rotatable pin 124, the handle 134 operates in a guide recess 146 that runs below a radial surface 148. As the handle 134 moves more toward the locked position (FIG. 1), the radial surface 148 gives way to a recess 150. Once the handle 134 reaches the recess 150, the engagement of the handle 134 and the radial surface 148 no longer prevents further upward movement of the rotatable pin 124 due to the tension in the spring 136. The handle 134 can move in the recess 150, which enables greater travel of the spring 136. Because movement of the handle 134 in the recess 150 is not limitless, the spring 136 always exerts some load on the rotatable pin 124.

The larger the pivoting range of the rotatable pin 124 and, thus, the handle 134, the wider the head 132 of this rotatable pin 124 can be. It is thus suggested that the pivoting range of the rotatable pin 124 be approximately 180°.

To ensure that the handle 134 remains in the assumed position, the friction, due to the spring forces, to which the head 132 of the rotatable pin 124 is exposed is quite great. However, it is preferred that the handle 134 is immobilized in a position, in which the rotatable pin 124 is fully loaded by the spring 136. This immobilization is an additional safeguard that ensures that the handle 134 remains in position when the mounting device 102 is installed. At the same time, this position is an indicator that the mounting device 102 is and assembled and mounted.

When permanently mounted, the immobilization of the handle 134 can be created by a screw (not shown). It is, however, preferred that the immobilization is designed as a stop device that does not permanently lock the handle 134. Thus, there would be hardly any noteworthy delay when switching between immobilizing and releasing the handle 134; yet, the handle 134 may nonetheless be reliably immobilized in its locked position.

The stop device can be a spring-loaded notch (not shown). However, an advantageous embodiment of the example mounting device 102 exists in that the stop device is designed as a notching on the weapon-side component 106 carrying the rotatable pin 124, with which the slightly springy handle and/or the handle 134 loaded by the spring 136 engages. Because the handle 134 must overcome considerable forces when the rotatable pin 124 is turned, the handle 134 must be quite long and might, thus, be deformable by the spring 136. But the associated rotatable pin 124 also assumes its final position through the effect of the spring 136 so that the handle 134 firmly connected to this rotatable pin 124 is able to perform a spring-loaded diagonal movement when the handle 134 is exposed to the full effect of the spring 136. In any case, this type of notching has proven that it holds the handle 134 in position by means of spring forces but does not require its own component.

The spring 136 could be a powerful spiral spring, such as the valve spring of a combustion engine. It is preferred that the spring 136 is designed such that the spring 136 can supply great spring force in a small installation space. Such springs 136 can be a disk spring bundle, a coil spring, a diaphragm element, etc. For example, disk springs can be adjusted based on their special characteristics such that the spring constant increases when the handle 134 assumes its final position.

In the alternative example shown in FIG. 6, the spring 136 is designed as one piece with the associated rotatable pin 124, preferably in the form of a slotted pin or tube. The spring bundle or the spring 136 is thus a captive part of the rotatable pin 124 and does not require its own component.

As shown in FIGS. 9 and 10, the apertures 110, 112 are preferably designed in a Picatinny rail 302 or another interface common for weapons, whereby the user advantageously has both mounting options as alternatives or in parallel.

In FIG. 10, the accessory device 106 preferably includes a Picatinny rail 302 or another interface common for weapons. One advantage to using a Picatinny rail 302 is that some out-dated installable accessory devices can only be attached to a weapon via such Picatinny rails. In addition, worn-out Picatinny rails that were made of very light or cheap materials can be replaced very quickly.

These illustrated example thereby create a mounting device 102 or an interface, that functions with just a few, robust parts and produces a reliable mounting, in which high forces can be transferred. The example mounting devices described herein also have several other advantages. For example, the mounting device or "interface" is free of marginal movement or wiggling after each mounting and sits in the same position (self-adjusting and reproducible or attachable in an exactly repeatable manner). The mounting device just has a few, simple parts, is economical, is easy to manufacture on the weapon side, and stresses the weapon structure as little as possible (for example, only when pulled) and the thin housing walls then remain dimensionally stable. Further, the mounting device is inconspicuous and, when the accessory device is mounted, protected from contamination at least on the weapon side, is easy to clean when the accessory device is demounted and permits single-lever operation, i.e. when an accessory device is attached, which can be operated with the hand that is holding the weapon or the accessory device.

Although certain example methods, apparatus and articles of manufacture have been described herein, the scope of coverage of this patent is not limited thereto. On the contrary, this patent covers all methods, apparatus and articles of manufacture fairly falling within the scope of the appended claims either literally or under the doctrine of equivalents.

What is claimed is:

1. An accessory mounting device for use with firearms, the mounting device comprising:

a first pin having a first head;

a second pin having a second head, wherein the second head projects radially beyond the second pin only on one side of the second pin;

a first aperture to receive the first pin, wherein the first aperture includes a first bore hole section and a first eccentric section;

a second aperture to receive the second pin, wherein the second aperture includes a second bore hole section and a second eccentric section, wherein the first and second eccentric sections have radii smaller than the radii of the first and second bore hole sections, respectively;

a first undercut associated with the first aperture, wherein the first undercut is compatible with the first head;

a second undercut associated with the second aperture, wherein the second undercut is compatible with the second head;

a spring-loaded locking device attached to the second pin, wherein the spring-loaded locking includes a spring having a spring force; and a handle associated with the spring-loaded locking device, wherein the handle moves the second pin against the spring force axially in the direction of the second head while rotating the second pin so that when the second pin is rotated by the handle, the second head pushes against the spring force on the second undercut.

2. The mounting device as defined in claim 1, wherein the first undercut and the second undercut face toward each other.

3. The mounting device as defined in claim 1, wherein the first undercut and the second undercut face away from each other.

4. The mounting device as defined in claim 1, wherein the at least first and second pins are attached to an accessory-side component.

5. The mounting device as defined in claim 1, wherein the first pin is fixed.

6. The mounting device as defined in claim 1, wherein the first and second heads form two engagement surfaces with the first and second undercuts.

7. The mounting device as defined in claim 1, wherein the first and second pins engage a single, separate component.

8. The mounting device as defined in claim 1, wherein the first and second apertures are formed in a single, separate component.

9. The mounting device as defined in claim 8, wherein the first and second apertures of the component are closed on the side of the first and second undercuts at least after mounting of the component.

10. The mounting device as defined in claim 1, wherein the accessory device has a fork with two branches for guiding the second pin, such that the second pin, when the accessory device is mounted, lies along two mainly axially parallel engagement surfaces, one in each fork branch.

11. The mounting device as defined in claim 1, wherein the spring experiences greater tension when the second pin is turned and the second head engages the second undercut.

12. The mounting device as defined in claim 1, wherein the handle is attached to the second pin radially and lies on a guide running in a radial plane for the majority of its pivoting, wherein the guide ends in a recess in an end area of the pivoting when the second head is located below the second undercut.

13. The mounting device as defined in claim 1, wherein the second pin has a pivoting range of approximately 180°.

14. The mounting device as defined in claim 1, wherein the handle is immobilized in a position in which the second pin is fully loaded by the spring.

15. The mounting device as defined in claim 14, wherein a stop device causes the handle to be immobilized.

16. The mounting device as defined in claim 15, wherein the stop device is designed as a notching that the handle engages.

17. The mounting device as defined in claim 1, wherein the second pin and the spring are integrally formed.

18. The mounting device as defined in claim 1, wherein the mounting device is attached to a Picatinny rail.

19. The mounting device as defined in claim 1, wherein the mounting device is integral with a Picatinny rail.

20. The mounting device as defined in claim 1, wherein the first and second eccentric sections are conically countersunk.

21. An accessory mounting device for use with firearms, the mounting device comprising:

a first pin having a first head;

a second pin having a second head, wherein the second head projects radially beyond the second pin only on one side of the second pin;

a first aperture to receive the first pin, wherein the first aperture includes a first bore hole section and a first eccentric section;

a second aperture to receive the second pin, wherein the second aperture includes a second bore hole section and a second eccentric section, wherein the first and second eccentric sections are conically countersunk;

a first undercut associated with the first aperture, wherein the first undercut is compatible with the first head;

a second undercut associated with the second aperture, wherein the second undercut is compatible with the second head;

a spring-loaded locking device attached to the second pin, wherein the spring-loaded locking includes a spring having a spring force; and a handle associated with the spring-loaded locking device, wherein the handle moves the second pin against the spring force axially in the direction of the second head while rotating the second pin so that when the second pin is rotated by the handle, the second head pushes against the spring force on the second undercut.

22. An accessory mounting device for use with firearms, the mounting device comprising:

a first pin having a first head;

a second pin having a second head, wherein the second head projects radially beyond the second pin only on one side of the second pin;

a first aperture to receive the first pin, wherein the first aperture includes a first bore hole section and a first eccentric section;

a second aperture to receive the second pin, wherein the second aperture includes a second bore hole section and a second eccentric section, wherein the first and second eccentric sections have radii smaller than the radii of the first and second bore hole sections, respectively;

a first undercut associated with the first aperture, wherein the first undercut is compatible with the first head;

a second undercut associated with the second aperture, wherein the second undercut is compatible with the second head;

a guiding rod coupled to the second pin; and a locking device that is spring-loaded with a spring and attached to the guiding rod, wherein the second pin can be moved by the force of the spring axially in the direction of the guiding rod so that the second head is biased toward the second undercut while the first pin is biased toward the first undercut.

23. The mounting device as defined in claim 22, wherein the second pin includes a handle that may be used to move the second pin.

* * * * *